US008092671B2

(12) United States Patent
Strack et al.

(10) Patent No.: US 8,092,671 B2
(45) Date of Patent: Jan. 10, 2012

(54) METHOD FOR PROCESSING HYDROCARBON PYROLYSIS EFFLUENT

(75) Inventors: Robert David Strack, Houston, TX (US); Richard C. Stell, Houston, TX (US); John R. Messinger, Kingwood, TX (US); Dane C. Grenoble, Houston, TX (US); John E. Asplin, Singapore (SG)

(73) Assignee: ExxonMobil Chemical Patents, Inc., Houston, TX (US)

( * ) Notice: Subject to any disclaimer, the term of this patent is extended or adjusted under 35 U.S.C. 154(b) by 0 days.

(21) Appl. No.: 12/643,470

(22) Filed: Dec. 21, 2009

(65) Prior Publication Data

US 2010/0096296 A1 Apr. 22, 2010

Related U.S. Application Data

(62) Division of application No. 11/177,076, filed on Jul. 8, 2005, now Pat. No. 7,718,049.

(51) Int. Cl.
*C10C 3/00* (2006.01)
*C10L 1/02* (2006.01)

(52) U.S. Cl. ..... 208/22; 44/311

(58) Field of Classification Search ..... 44/311; 422/169, 173; 208/14–23, 39, 42–45, 1–7
See application file for complete search history.

(56) References Cited

U.S. PATENT DOCUMENTS

| | | | | |
|---|---|---|---|---|
| 2,343,192 | A | 2/1944 | Kuhn | |
| 2,695,264 | A | 11/1954 | Taff et al. | |
| 3,060,116 | A | 10/1962 | Hardin, Jr. et al. | |
| 3,316,183 | A * | 4/1967 | King et al. | 252/510 |
| 3,907,661 | A | 9/1975 | Gwyn et al. | |
| 3,922,335 | A * | 11/1975 | Jordan et al. | 423/450 |
| 3,923,921 | A | 12/1975 | Kohfeldt | |
| 3,959,420 | A | 5/1976 | Geddes et al. | |
| 4,121,908 | A | 10/1978 | Raab et al. | |
| 4,150,716 | A | 4/1979 | Ozaki et al. | |
| 4,233,137 | A | 11/1980 | Ozaki et al. | |
| 4,279,733 | A | 7/1981 | Gwyn | |
| 4,279,734 | A | 7/1981 | Gwyn | |
| 4,431,512 | A * | 2/1984 | Dickakian | 208/44 |

(Continued)

FOREIGN PATENT DOCUMENTS

EP 0 000 205 1/1982

(Continued)

OTHER PUBLICATIONS

Lohr, B. et al., "*Steam-cracker Economy Keyed to Quenching*," Oil Gas Journal, vol. 76 (No. 20) pp. 63-68 (1978).

*Primary Examiner* — Glenn Caldarola
*Assistant Examiner* — Pamela H Weiss

(57) ABSTRACT

A method is disclosed for treating gaseous effluent from a hydrocarbon pyrolysis unit to provide steam cracked tar of reduced asphaltene and toluene insolubles content. The method is suitable for preparing reduced viscosity tar useful as a fuel blending stock, or feedstock for producing carbon black, while reducing or eliminating the need for externally sourced lighter aromatics additives to meet viscosity specifications. The method comprises drawing steam cracked tar from a separation vessel, e.g., a primary fractionator or tar knock-out drum, cooling the tar, and returning it to the separation vessel to effect lower overall tar temperatures within the separation vessel, in order to reduce viscosity increasing condensation reactions. An apparatus for carrying out the method is also provided.

6 Claims, 1 Drawing Sheet

U.S. PATENT DOCUMENTS

| | | | | |
|---|---|---|---|---|
| 4,444,697 | A | 4/1984 | Gater et al. | |
| 4,446,003 | A | 5/1984 | Burton et al. | |
| 4,457,364 | A | 7/1984 | DiNicolantonio et al. | |
| 4,692,237 | A * | 9/1987 | Hsu et al. | 208/177 |
| 4,721,557 | A * | 1/1988 | Staggs | 208/68 |
| 5,092,981 | A | 3/1992 | Russo | |
| 5,107,921 | A | 4/1992 | Tsai | |
| 5,215,649 | A | 6/1993 | Grenoble | |
| 5,294,347 | A | 3/1994 | Byrne et al. | |
| 5,324,486 | A | 6/1994 | Russo | |
| 5,443,715 | A * | 8/1995 | Grenoble et al. | 208/95 |
| 6,183,626 | B1 | 2/2001 | Lenglet et al. | |

FOREIGN PATENT DOCUMENTS

| | | |
|---|---|---|
| EP | 0 031 609 | 12/1983 |
| GB | 1 390 309 | 4/1975 |
| GB | 1 390 382 | 4/1975 |
| JP | 2001-40366 | 2/2001 |
| WO | WO 93/12200 | 6/1993 |
| WO | WO 00/56841 | 9/2000 |

* cited by examiner

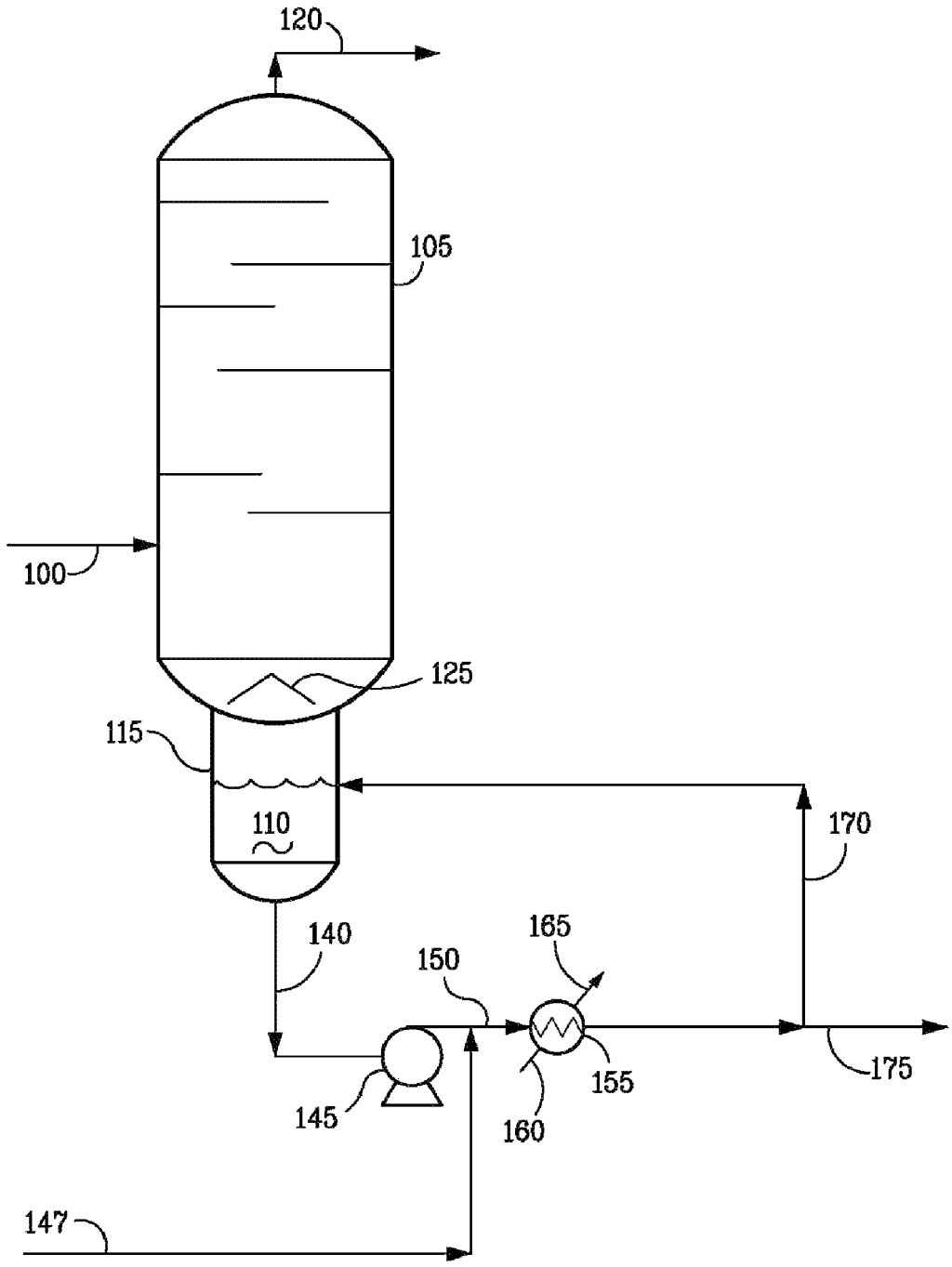
120
105
100
125
115
110
170
140
165
150
155
175
145
160
147

METHOD FOR PROCESSING HYDROCARBON PYROLYSIS EFFLUENT

CROSS-REFERENCE OF RELATED APPLICATIONS

This application is a divisional which claims the benefit of and priority of U.S. application Ser. No. 11/177,076 filed Jul. 8, 2005 now U.S. Pat. No. 7,718,049 (allowed Nov. 17, 2009, but not yet granted), the disclosure of which is herein incorporated by reference in its entirety. The present application expressly incorporates by reference herein the entire disclosures of U.S. Pub. No. 2007-0007172A1 filed Jul. 8, 2005, U.S. Pub. No. 2007-0007175A1 filed Jul. 8, 2005, U.S. Pub. No. 2007-0007171A1 filed Jul. 8, 2005, U.S. Pub. No. 2007-0007169A1 filed Jul. 8, 2005, U.S. Pub. No. 2007-0007174A1 filed Jul. 8, 2005, and U.S. Pub. No. 2007-0007173A1 filed Jul. 8, 2005, all of which are incorporated herein by reference.

FIELD OF THE INVENTION

The present invention is directed to a method for processing the gaseous effluent from hydrocarbon pyrolysis units, especially those units utilizing naphtha or heavier feeds. In particular, this invention relates to a method for upgrading steam cracked tar derived from hydrocarbon pyrolysis.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules. The pyrolysis process, however, produces molecules which tend to combine to form high molecular weight materials known as tars. Tars are high-boiling point, viscous, reactive materials that can foul equipment under certain conditions. Although not wishing to be bound by any particular theory, it is believed that the steam cracked liquid product, as first produced in the steam cracker furnace, contain free radical molecules, vinyl-aromatic molecules, and other reactive species, and is highly reactive at moderately high temperatures commonly found in the downstream processing of steam cracked liquid product. The unsaturated functional groups of such aromatic molecules include those selected from the group consisting of olefinic groups and acetylenic groups. More specifically, such unsaturated functional groups are selected from the groups consisting of indenes, acenapthalenes and other cyclopentenoaromatics; vinylbenzenes, and other vinyl aromatics having one aromatic ring; divinylbenzenes, vinylnaphthalenes, divinylnaphthalenes, vinylanthracenes, vinylphenanthrenes, and other vinyl- and divinylaromatics having 2 or more aromatic rings. This reactivity of such aromatic molecules tends to lead to reactions which significantly downgrade the properties of the liquid product.

The formation of tars, after the pyrolysis effluent leaves the steam cracking furnace can be minimized by rapidly reducing the temperature of the effluent exiting the pyrolysis unit to a level at which the tar-forming reactions are greatly slowed.

One technique used to cool pyrolysis unit effluent and remove the resulting heavy oils and tars employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas and heavier feedstocks, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly, in most commercial liquid crackers, cooling of the effluent from the cracking furnace is normally achieved using a system of transfer line heat exchangers, a primary fractionator, and a water quench tower or indirect condenser. For a typical heavier than naphtha feedstock, the transfer line heat exchangers cool the process stream to about 1100° F. (594° C.), efficiently generating super-high pressure steam which can be used elsewhere in the process. The primary fractionator is normally used to condense and separate the tar from the lighter liquid fraction, known as pyrolysis gasoline, and to recover the heat between about 200° to 600° F. (93° to 316° C.). The water quench tower or indirect condenser further cools the gas stream exiting the primary fractionator to about 100° F. (38° C.) to condense the bulk of the dilution steam present and to separate pyrolysis gasoline from the gaseous olefinic product, which is then sent to a compressor. Sometimes an intermediate boiling range stream known as steam cracked gas oil boiling, say, within the range of about 400° to about 550° F. (204° to 288° C.), is also produced as a sidestream.

Moreover, despite the fractionation that takes place between the tar and gasoline streams in a primary fractionator, both streams often need to be processed further. Sometimes the tar needs to be stripped to remove light components, whereas the gasoline may need to be refractionated to meet its end point specification. An additional concern relates to providing steam cracked tar having characteristics which make it suitable for high value use.

Steam cracker tar is the heaviest material made in the steam cracking process, comprising essentially all the product that boils above about 500° F. (260° C.). Such tar contains a high concentration of aromatic compounds produced by chemical reactions which lead to molecular weight growth of steam cracked liquids, e.g., condensation and/or polymerization reactions in the cracking process. These reactions can occur to a large extent in the primary fractionator or quench tower at the temperatures that normally prevail in steam cracker primary fractionator towers. These molecular weight growth reactions leading to asphaltene formation are rather fast and are not as easily reversed as they are prevented.

The yield of tar depends primarily on the cracker feed type, e.g., about 1 wt % from naphtha and 30% or more from very heavy gas oil. The value of tar is generally based on its use as a fuel or fuel blend stock. Sometimes it can be used as a feedstock for making carbon black. Tar can also be fed to a partial oxidation process where it is converted to synthetic fuel gas.

Molecules in tar containing more than about seven aromatic rings are insoluble in heptane and are known as asphaltenes. Asphaltenes are high molecular weight, complex aromatic ring structures and may exist as colloidal dispersions. With their aromatic ring structure, asphaltenes are not soluble in straight chain alkanes (hexane, heptane). They are soluble in aromatic solvents like xylene and toluene. Asphaltene content can be measured by various techniques known to those of skill in the art, e.g., ASTM D3279.

The heavier molecules in tar that are not soluble in toluene are known as toluene insolubles, or TI. Toluene Insolubles (coagulated/uncoagulated) are the solids remaining after oxidation resins, or pentane insolubles, have been diluted with toluene. Insoluble resins are the difference in weight between the pentane insolubles and the toluene insolubles. Toluene insolubles can be measured by methods well known to those skilled in the art, e.g., ASTM D-893, ASTM D4312-05(a) 2005, Standard Test Method for Toluene-Insoluble (TI) Content of Tar and Pitch (Short Method), or ASTM D4072-98 (2003)e1, Standard Test Method for Toluene-Insoluble (TI) Content of Tar and Pitch.

Asphaltenes and TI affect the quality and resulting value of the tar in several ways. They make steam cracker tar incompatible with many other fuel oils. For example, asphaltenes tend to precipitate when tar is mixed with paraffinic stocks, such as residua from paraffinic crude oil. This limits the potential marketability of tar into the fuel oil market. Moreover, asphaltenes and TI are not desirable components when tar is used in the manufacture of carbon black. Carbon black producers generally prefer feeds with lower asphaltene and TI concentrations, and they set upper limits on acceptable concentrations of these components.

Because asphaltenes and TI make tar more viscous, it often becomes necessary to mix a lighter aromatic material such as steam cracked gas oil with the tar, in order to meet product viscosity specifications. For crackers that feed naphtha or highly paraffinic gas oil, the amount of light blend stock required can exceed the quantity of co-produced steam cracked gas oil, which renders the steam cracking process "out of quench balance" inasmuch as the quantity of light blend stock produced in the cracker is insufficient to thin produced steam cracker tar to its desired viscosity. In such cases, an external source of light, highly aromatic material must be added, and this can be difficult to obtain and costly. Alternately, cracking severity must be reduced which imposes yield and conversion restrictions on the steam cracking process.

In view of the foregoing, it would be useful to provide a method for treating pyrolysis unit effluent, particularly the effluent from the steam cracking of hydrocarbonaceous feeds include naphtha and heavier feeds which yield greater amounts of steam cracker tar than lighter feeds. Accordingly, it would be useful to provide a steam cracking process which produces steam cracker tar having a reduced asphaltenes and/or toluene insolubles content, particularly where the process can be carried out in the presence or absence of a primary fractionator tower and its ancillary equipment, e.g., in processes utilizing a tar knock-out drum.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone, and a separating zone.

Lohr et al., "Steam-cracker Economy Keyed to Quenching," Oil Gas J., Vol. 76 (No. 20) pp. 63-68 (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent resulting from steam cracking furnace comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 220° to 266° F. (105° to 130° C.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 proposes a method for cooling a fluid such as a cracked reaction product by using transfer line exchangers having two or more separate heat exchanging sections.

U.S. Pat. No. 5,294,347 proposes that in ethylene manufacturing plants, a water quench column cools gas leaving a primary fractionator and that in many plants, a primary fractionator is not used and the feed to the water quench column is directly from a transfer line exchanger.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

U.S. Pat. No. 5,215,649 teaches a method for upgrading steam cracker tars by injecting hydrogen donor diluent into a hot cracked product stream at a point downstream of a point where high temperature cracking is stopped by cooling.

SUMMARY OF THE INVENTION

In one aspect, the present invention relates to a method for treating gaseous effluent from a hydrocarbon pyrolysis unit to provide steam cracked tar of reduced asphaltene and toluene insolubles content. Such a method is suitable for preparing reduced viscosity tar useful as a fuel blending stock, or feedstock for producing carbon black, while reducing or eliminating the need for externally sourced lighter aromatics additives to meet viscosity specifications. The method comprises drawing steam cracked tar from a separation vessel, e.g., a primary fractionator or tar knock-out drum, cooling the tar, and returning it to the separation vessel to effect lower overall tar temperatures within the separation vessel, in order to reduce viscosity increasing condensation reactions.

In another aspect, the present invention is directed to a method for treating gaseous effluent from a hydrocarbon pyrolysis process unit, the method comprising: (a) cooling said gaseous effluent at least to a temperature at which tar, formed by the pyrolysis process, condenses from the effluent to provide a partially condensed effluent; (b) passing said partially condensed effluent to a separation vessel; (c) removing condensed tar from the separation vessel; (d) cooling said condensed tar; and (e) recycling at least a portion of said cooled tar to said separation vessel at or below the level at which said partially condensed effluent enters said separation vessel.

In one configuration of this aspect of the invention, the separation vessel is a fractionation column. Typically, cooled tar can be introduced in a smaller diameter boot section of said fractionation column, located at the bottom end of the fractionation column. The boot is designed to reduce the overall residence time of the tar, to reduce asphaltene growth.

In another configuration of this aspect of the invention, the separation vessel is a tar knockout drum, where the condensed tar separates from the gaseous effluent. The knockout drum can be a simple empty vessel, lacking distillation plates or stages.

In still another configuration of this aspect of the invention, the temperature of the partially condensed effluent is no greater than about 650° F. (343° C.), typically from about 400° to about 650° F. (204° to 343° C.), e.g., from about 450° to about 600° F. (232° to 316° C.).

In yet still another configuration of this aspect of the invention, the gaseous effluent is produced by pyrolysis of a heavy hydrocarbon feed.

In still yet another configuration of this aspect of the invention, the gaseous effluent is produced by pyrolysis of a feed selected from at least one of naphtha, gas oil, kerosine, hydrocrackate, crude oil residua, and crude oil.

In another configuration of this aspect of the invention, the cooled tar is introduced to the separation vessel at a temperature at least about 100° F. (56° C.), typically at least about 200° F. (111° C.), e.g., at least about 240° F. (133° C.), below the temperature of the effluent entering the separation vessel.

In yet another configuration of this aspect of the invention, the cooled tar is introduced to the separation vessel so as to provide an average temperature for tar within the separation vessel of less than about 350° F. (177° C.), typically less than about 300° F. (149° C.), e.g., less than about 275° F. (149° C.).

In another configuration of this aspect of the invention, the cooled tar produced in (d) is cooled to less than about 200° F. (93° C.).

In still another configuration of this aspect of the invention, the temperature for tar within the separation vessel is taken at a reduced diameter boot of a fractionation column.

In yet still another configuration of this aspect of the invention, the recycled tar comprises at least about 10 wt %, typically at least about 50 wt %, e.g., at least about 80 wt %, of the tar removed from the separation vessel.

In still yet another configuration of this aspect of the invention, the tar removed from the separation vessel contains less than about 20 wt %, typically less than about 10 wt %, e.g., less than about 8 wt %, asphaltenes as measured by ASTM D3279, say, less than about 8 wt % asphaltenes as measured by ASTM D3279 after remaining as bottoms for at least 5 minutes in the separation vessel.

In yet still another configuration of this aspect of the invention, the tar removed from the separation vessel contains less than about 0.5 wt %, typically less than about 0.1 wt %, toluene insolubles as measured by ASTM D893.

In another configuration of this aspect of the invention, the tar removed from the separation vessel contains asphaltenes and toluene insolubles at levels sufficiently low to provide a carbon black feedstock.

In yet another configuration of this aspect of the invention, the tar removed from the separation vessel contains asphaltenes and toluene insolubles at levels sufficiently low to provide a blending stock for fuels.

In still another configuration of this aspect of the invention, the tar removed from the separation vessel contains asphaltenes and toluene insolubles at levels sufficiently low to provide a blending stock for atmospheric resid or vacuum resid fuels.

In yet still another configuration of this aspect of the invention, the cooled tar is introduced to the separation vessel below the liquid-vapor interface occurring in the vessel. Typically, the cooled tar is introduced to the separation vessel below the liquid-vapor interface above and substantially adjacent to which lies a baffle for reducing liquid-vapor contact.

In still yet another configuration of this aspect of the invention, a purge stream is introduced to the separation vessel to reduce liquid-vapor contact. Typically, the purge stream is selected from steam, inert gas such as nitrogen, and substantially non-condensible hydrocarbons, such as those obtained from steam cracking, examples of which include cracked gas and tail gas.

In another configuration of this aspect of the invention, the recycling suffices to reduce viscosity of the tar removed from the separation vessel to an extent sufficient to meet viscosity specifications, in the absence or reduction of an added externally sourced light blend stock otherwise necessary in the absence of said recycling.

In another aspect, the present invention relates to a method for reducing the formation of asphaltenes in gaseous effluent from a hydrocarbon pyrolysis process unit, the method comprising: (a) passing the gaseous effluent through at least one primary heat exchanger (typically a transfer line heat exchanger), thereby cooling the gaseous effluent and generating high pressure steam; (b) passing the gaseous effluent from step (a) through at least one secondary heat exchanger (typically a transfer line heat exchanger) having a heat exchange surface maintained at a temperature such that part of the gaseous effluent condenses to form a liquid coating on the surface, thereby further cooling the remainder of the gaseous effluent to a temperature at which tar, formed by the pyrolysis process, condenses; (c) passing the effluent from step (b) to a separation vessel, where the condensed tar separates from the gaseous effluent; (d) removing the tar from the bottom of the separation vessel; (e) cooling the tar removed from the separation vessel; and (f) recycling a sufficient volume of the cooled tar to the separation vessel to reduce the temperature of the tar leaving the separation vessel to an extent sufficient to reduce the formation of asphaltenes in the tar.

In still another aspect, the present invention relates to a hydrocarbon cracking apparatus comprising: (a) a reactor for pyrolyzing a hydrocarbon feedstock, the reactor having an outlet through which gaseous pyrolysis effluent can exit the reactor; (b) at least one means for cooling said gaseous pyrolysis effluent to a temperature at which tar, formed during pyrolysis, condenses; (c) a vessel for separating condensed tar from the gaseous pyrolysis effluent, the vessel having a first inlet through which the gaseous pyrolysis effluent and condensed tar enter, a second inlet lower than the first inlet, and an outlet through which the condensed tar can exit the vessel; and (d) a means for cooling the condensed tar and recycling a portion of the condensed tar to the second inlet of the vessel.

In one configuration of this aspect of the invention, the at least one means for cooling in step (b) comprises a transfer line heat exchanger.

In another configuration of this aspect of the invention, the vessel (c) is a fractionation column.

In yet another configuration of this aspect of the invention, the vessel (c) is a primary fractionator.

In still another configuration of this aspect of the invention, the vessel (c) is a tar knock-out drum.

In yet still another configuration of this aspect of the invention, the second inlet is at a level below a liquid-vapor interface within the vessel.

In still yet another configuration of this aspect of the invention, the apparatus further comprises a baffle above the second inlet.

In yet another aspect, the present invention relates to a steam cracked tar composition which contains less than about 20 wt % asphaltenes, typically less than about 10 wt % asphaltenes, e.g., less than about 8 wt % asphaltenes as measured by ASTM D3279 and less than about 0.5 wt % toluene insolubles, typically less than about 0.2 wt % toluene insolubles, e.g., less than about 0.1 wt % toluene insolubles as measured by ASTM D893.

In one configuration of this aspect of the invention, the composition is a carbon black feedstock.

In another configuration of this aspect of the invention, the composition is a blending stock for fuels, e.g., a blending stock for atmospheric resid or vacuum resid fuels.

In yet another configuration of this aspect of the invention, the composition further comprises a blendstock selected from the group consisting of cat cracker bottoms, quench oil, steam cracked gas oil, atmospheric residuum, and vacuum residuum.

BRIEF DESCRIPTION OF THE DRAWING

FIG. 1 is a schematic flow diagram of a method according to the present invention of treating the gaseous effluent from the steam cracking of a gas oil feed to provide high value steam cracked tar while maintaining quench balance of the steam cracking process.

DETAILED DESCRIPTION OF THE EMBODIMENTS

The present invention provides an efficient way of treating the gaseous lower olefin-containing effluent stream from a hydrocarbon pyrolysis reactor so as to remove and recover heat from the stream while providing high value steam cracked tar product and maintaining quench balance.

Typically, the effluent used in the method of the invention is produced by pyrolysis of a hydrocarbon feed boiling in a temperature range, say, from about 104° to about 1022° F. (40° to 550° C.), such as light naphtha or gas oil. Lighter feeds may also be used, but given their reduced tar make in steam cracking are less advantageously utilized by the present invention. Preferably, the effluent used in the method of the invention is produced by pyrolysis of a hydrocarbon feed boiling in a temperature range from above about 356° F. (180° C.), such as feeds heavier than naphtha. Such feeds include those boiling in the range from about 200° to about 1000° F. (93° to 538° C.), say, from about 400° to about 950° F. (204° to 510° C.). Typical heavier than naphtha feeds can include heavy condensates, gas oils, kerosines, hydrocrackates, condensates, crude oils, and/or crude oil fractions, e.g., reduced crude oils. The temperature of the gaseous effluent at the outlet from the pyrolysis reactor is normally in the range of from about 1400° to 1700° F. (760° to 927° C.) and the invention provides a method of cooling the effluent to a temperature at which the desired $C_2$-$C_4$ olefins can be compressed efficiently, generally less than about 212° F. (100° C.), for example less than about 167° F. (75° C.), such as less than about 140° F. (60° C.) and typically from about 68° to about 122° F. (20° to 50° C.).

In particular, the present invention can be utilized in a method which comprises passing the effluent through at least one primary transfer line heat exchanger, which is capable of recovering heat from the effluent down to a temperature where fouling is incipient. As needed, this heat exchanger can be periodically cleaned by steam decoking, steam/air decoking, or mechanical cleaning. Conventional indirect heat exchangers, such as tube-in-tube exchangers or shell and tube exchangers, may be used in this service. In one embodiment, the primary heat exchanger cools the process stream to a temperature between about 644° and 1202° F. (340° and about 650° C.), such as about 1100° F. (593° C.), using water as the cooling medium and generating super high pressure steam.

On leaving the primary heat exchanger, the cooled gaseous effluent is still at a temperature above the hydrocarbon dew point (the temperature at which the first drop of liquid condenses) of the effluent. For a typical heavy feed under cracking conditions, the hydrocarbon dew point of the effluent stream ranges from about 700° to about 1200° F. (371° to 649° C.), say, from about 900° to about 1100° F. (482° to 593° C.). Above the hydrocarbon dew point, the fouling tendency is relatively low, i.e., vapor phase fouling is generally not severe, and there is no liquid present that could cause fouling. Tar liquid is knocked out from such heavy feeds at a temperature ranging from about 400° to about 650° F. (204° to 343° C.), say, from about 450° to about 600° F. (232° to 316° C.).

Conveniently, a secondary transfer line heat exchanger also can be provided and is operated such that it includes a heat exchange surface cool enough to condense part of the effluent and generate a liquid hydrocarbon film at the heat exchange surface. The liquid film in one embodiment is generated in situ. The liquid film is preferably at or below the temperature at which tar is produced, typically at about 374° F. to about 599° F. (190° C. to 315° C.), such as at about 232° C. (450° F.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary (or "wet") transfer line exchanger must cool the process stream continuously to the temperature at which tar is produced. If the cooling is stopped before this point, fouling is likely to occur because the process stream would still be in the fouling regime. This secondary transfer line exchanger is particularly suitable for use with light liquid feeds, such as naphtha.

In an alternate embodiment, the gaseous effluent from the steam cracker furnace is subjected to direct quench, at a point typically between the furnace outlet and the separation vessel (primary fractionator or tar knock-out drum). The quench is effected by contacting the effluent with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench liquids include liquid quench oil, such as those obtained by a downstream quench oil knock-out drum, pyrolysis fuel oil and water, which can be obtained from various suitable sources, e.g., condensed dilution steam.

After passage through the direct quench and/or transfer line heat exchanger(s), the cooled effluent is fed to the separation vessel (a primary fractionator or at least one tar knock-out drum), wherein the condensed tar is separated from the effluent stream. If desired, multiple knock-out drums may be connected in parallel such that individual drums can be taken out of service and cleaned while the plant is operating. The tar removed at this stage of the process typically has an initial boiling point ranging from about 300° to about 600° F. (149° to 316° C.), typically, at least about 392° F. (200° C.).

The quenched furnace effluent entering the primary fractionator or tar knock-out drum(s) should be at a sufficiently low temperature, typically at about 375° F. (191° C.) to about 600° F. (316° C.), such as at about 550° F. (288° C.), that the tar separates rapidly.

In accordance with the present invention, up to about 70 wt % of asphaltenes in steam cracker tar can be prevented from forming by quenching the tar in the bottom of a separation vessel, e.g, a primary fractionator or tar knock-out drum. Toluene insolubles (TI) content is also significantly reduced. Such reduction occurs because a significant percentage of the asphaltenes and TI in steam cracker tar are made in the primary fractionator by reactive components in the raw tar undergoing condensation/polymerization to form higher molecular weight compounds. Such condensation/polymerization is believed to be a function of temperature and holdup time of the tar within the separation vessel. Absent quenching, tar exiting a steam cracking furnace can typically contain from about 4 to about 11 wt % asphaltenes, while tar product taken from the primary fractionator can contain from about 21 to about 30 wt % asphaltenes. Likewise, TI can increase from about 0.02 wt % at the furnace outlet to about 0.13 wt % in tar product from a separation vessel where no tar quenching occurs.

Quenching of the tar within the separation vessel in accordance with the invention can be accomplished by pumping a stream of tar taken from the bottom of the separation vessel through a tar cooler and recycling it to the separation vessel, e.g. the primary fractionator or tar knock-out drum. A portion of the tar product taken from a point downstream of the tar cooler is recycled. In the example, sufficient material is recycled to reduce the temperature from about 540° to about 300° F. (282° to 149° C.). The rate of asphaltene and TI formation is greatly reduced at this temperature.

The tar cooler can be any suitable heat exchanger means, e.g., a shell-and-tube exchanger, spiral wound exchanger, airfin, or double-pipe exchanger. Suitable heat exchanger media for tar coolers include, cooling water, quench water and air. Sources of such media include plant cooling towers, and water quench towers. Typical heat exchange medium inlet temperatures for the tar cooler range from about 100° to about 250° F. (38° to 121° C.), e.g., from about 80° to about 220° F. (27° to 104° C.). Typical heat exchange medium outlet temperatures for the tar cooler range from about 100° to about 250° F. (38° to 93° C.), e.g., from about 120° to about 200° F. (49° to 93° C.). The heat exchange medium taken from the outlet can be used as a heating medium for other streams or cycled to the water quench tower or cooling tower.

Viscosity of the tar taken from the bottom of the separating vessel can be controlled by the addition of a light blend stock, typically added downstream of the pump used to circulate the steam cracker tar. Such stocks include steam cracked gas oil, distillate quench oil and cat cycle oil and are characterized by viscosity at a temperature of 200° F. (93° C.) of less than about 1,000 centistokes (cSt), typically less than about 500 cSt, e.g., less than about 100 cSt.

The tar liquid recycle stream is introduced to the separation vessel in a way that minimizes contacting with the vapor in the separation vessel. If the recycle stream were simply sprayed into the vapor space, it would tend to heat up as a result of mixing with the large quantity of hot vapor present and would also absorb light components from the vapor, which is not desired. Instead, the recycle should be introduced near or preferably just below the liquid-vapor interface in the bottom of the vessel. This ensures that the tar is cooled to the desired temperature and minimizes the absorption of light components in the tar. An optional baffle placed above the vapor-liquid interface reduces contact of the recycle with hot vapor.

The gaseous overhead of the separation vessel is directed to a recovery train for recovering $C_2$ to $C_4$ olefins, inter alia.

The invention will now be more particularly described with reference to the examples shown in the accompanying drawings.

Referring to FIG. 1, in the method of an example of the invention, a quenched furnace effluent 100 from a steam cracking reactor which has been quenched to a temperature ranging from about 450° to about 580° F. (232° to 304° C.) is at or slightly below the temperature at which the tar of satisfactory quality condenses. The mixed liquid and vapor effluent is passed into at least one primary fractionator 105 (or alternately, a tar knock-out drum) and is separated into a tar fraction 110 removed as bottoms from boot 115 and a gaseous fraction containing cracked gas taken as overhead 120 for further processing. A baffle 125 is located slightly above the boot 115 (and the normal liquid level of the bottoms 110) to prevent or reduce vapor-liquid mixing within the separation vessel 105. The bottoms 110 maintained within the separation vessel 105 at an average temperature of about 300° F. (149° C.), are taken from the boot 115 and directed via line 140 to tar pump 145 and thence via line 150 to tar cooler 155 through which heat exchange medium is added via tar cooler heat exchange medium inlet 160 and withdrawn via tar cooler heat exchange medium outlet 165, with heat exchange medium inlet temperature of about 90° F. (32° C.), and heat exchange medium outlet temperature of about 110° F. (43° C.). Light blend stock may be added for viscosity control via line 147 upstream of the tar cooler 155. The tar cooler 155 typically reduces tar temperature by at least about 20° F. (11° C.), e.g., at least about 50° F. (28° C.). At least a portion of the tar effluent from the tar cooler 155 cooled to about 120° F. (49° C.) is directed via line 170 to the boot 115 at a level at or just below the liquid-vapor interface in the bottom of the primary fractionator 105. Cooled tar can be removed via line 175.

The invention typically reduces the asphaltene level in tar leaving the primary fractionator by about two-thirds. In those instances where the concentration of asphaltenes in furnace effluent tar is about 4 wt %, after quenching of the furnace effluent to 540° F. (282° C.) and transport to the primary fractionator for 10 seconds, the asphaltene content would increase to about 6.3 wt %. If this tar remains for 12 minutes at 540° F. (282° C.) in the bottom of the primary fractionator, the asphaltene level typically increases to about 23.2 wt % in the tar product. In an embodiment of the present invention, wherein tar in the separation vessel is cooled to about 300° F. (149° C.) and held for 12 minutes, the asphaltene level in the tar product would only be about 7.2 wt %. In one embodiment, cooling the tar product to less than about 200° F. (93° C.), e.g., less than about 150° F. (66° C.), say about 120° F. (49° C.) mitigates further asphaltene growth during long term storage. In another embodiment, the tar product is blended with other blendstock, including but not limited to cat cracker bottoms, quench oil, steam cracked gas oil, atmospheric residuum, and vacuum residuum. Blending with such materials reduces the further formation of asphaltenes during storage and handling by diluting the asphaltene precursors in the blended stream.

The present invention is especially suited to use with primary fractionator systems employing distillate-quench technology. With this type of primary fractionator, implementing the invention is relatively straightforward and cooling the tar does not have a significant impact on energy efficiency, because most of the furnace effluent heat is recovered using a distillate pumparound that is not affected by use of the invention. The invention can also be used in steam cracker processes that utilize a tar knock-out drum in lieu of a primary fractionator for treating quenched furnace effluent. However, the invention would not be particularly suitable for use with primary fractionators that employ bottoms-quench technology because a bottoms quench primary fractionator uses a tar pumparound to recover a significant quantity of heat from the furnace effluent. Inasmuch as efficient recovery of this heat requires that the tar be kept at elevated temperature for quite a long time, cooling the tar in the bottoms of such a primary fractionator in accordance with the present invention would likely incur a significant debit for reduced heat recovery.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A steam cracked tar composition which contains less than about 10 wt % asphaltenes as measured by ASTM D3279 and less than 0.1 wt % toluene insolubles as measured by ASTM D893 wherein the steam cracked tar composition has an initial boiling range from about 149° C. to about 316° C.

2. The composition of claim 1 which contains less than about 8 wt % asphaltenes as measured by ASTM D3279 and less than about 0.1 wt % toluene insolubles as measured by ASTM D893.

3. The composition of claim 1 that is a carbon black feedstock.

4. The composition of claim 1 that is a blending stock for fuels.

5. The composition of claim 1 that is a blending stock for atmospheric residuum or vacuum residuum fuels.

6. The composition of claim 1 which further comprises a blendstock selected from the group consisting of catalytic cracker bottoms, quench oil, steam cracked gas oil, atmospheric residuum, and vacuum residuum.

* * * * *